US006438349B2

(12) United States Patent
Ando

(10) Patent No.: US 6,438,349 B2
(45) Date of Patent: Aug. 20, 2002

(54) FIXING MEMBER, FIXING ASSEMBLY AND IMAGE-FORMING APPARATUS

(75) Inventor: Atsutoshi Ando, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/852,625

(22) Filed: May 11, 2001

(30) Foreign Application Priority Data

May 15, 2000 (JP) ..... 2000-141865
Mar. 7, 2001 (JP) ..... 2001-063510

(51) Int. Cl.[7] ..... G03G 15/20
(52) U.S. Cl. ..... 399/333; 219/216
(58) Field of Search ..... 399/333, 330, 399/328, 329; 249/216; 118/60; 432/60; 430/99, 124; 492/46, 53, 56

(56) References Cited

U.S. PATENT DOCUMENTS 5,045,891 A * 9/1991 Senba et al. ..... 399/333 X
5,561,511 A * 10/1996 Mizunuma et al. ..... 399/333
5,717,988 A * 2/1998 Jinzai et al. ..... 399/333
5,765,085 A * 6/1998 Law et al. ..... 399/329
6,002,106 A * 12/1999 Kataoka et al. ..... 219/216

FOREIGN PATENT DOCUMENTS

JP 2000-19879 1/2000

* cited by examiner

*Primary Examiner*—Sophia S. Chen
(74) *Attorney, Agent, or Firm*—Fitzpatrick, Cella, Harper & Scinto

(57) ABSTRACT

A fixing member for use in a fixing assembly of an image-forming apparatus of an electrophotographic or electrostatic recording system has a conductive layer and a releasing layer formed on the conductive layer. In the releasing layer, any one or both of medium-resistance particles and medium-resistance whiskers are dispersed, and the releasing layer has a surface resistivity of $1.0\times10^8$ Ω or below and a volume resistivity of $1.0\times10^8$ Ωcm or above. The fixing assembly having such a fixing member may be provided in an image-forming apparatus having the fixing assembly, and the fixing member has a superior anti-offset properties and proofness to smeared image trailing edges.

27 Claims, 7 Drawing Sheets

FIXING MEMBER, FIXING ASSEMBLY AND IMAGE-FORMING APPARATUS

BACKGROUND OF THE INVENTION

1. Field of the Invention

This invention relates to a fixing member of a fixing assembly used in image-forming apparatus employing an image-forming process such as electrophotography or electrostatic recording. More particularly, this invention relates to a fixing member used in a heat fixing assembly by means of which an unfixed toner image formed and carried on a recording material (such as a transfer material, printing paper, photosensitive paper or electrostatic recording paper) by a transfer system or a direct system in an image-forming processing section is treated by heat fixing to form a fixed image. It also relates to a fixing assembly having such a fixing member and an image-forming apparatus having the fixing assembly.

2. Related Background Art

Conventionally, in fixing assemblies provided in image-forming apparatus employing an image-forming process such as electrophotography or electrostatic recording, heat fixing assemblies are widely used in which a recording material (hereinafter also "transfer material") holding an unfixed image thereon is passed through a nip formed between a fixing roller and a pressure roller which are rotated in pressure contact with each other, to fix the toner image to the recording material. An example of an image-forming apparatus having a conventional heat fixing assembly is shown in FIG. 5.

In the apparatus shown in FIG. 5, a fixing roller 10 which is a fixing member having a heating element comprises a hollow mandrel made of aluminum and a heating element halogen lamp provided inside the mandrel. From the interior of the hollow mandrel, a recording material is heated at a temperature high enough to cause the toner (toner image) held thereon to melt by supplying electricity from a power source (not shown).

On the periphery of the hollow mandrel, a releasing layer comprised of a material such as a polytetrafluoroethylene copolymer (PTFE) or a perfluoroalkoxytetrafluoroethylene copolymer (PFA) is formed which has an excellent performance for releasability and resistance to heat. The releasing layer is formed on the hollow mandrel by covering its surface with a material formed in a tube, or by coating it with a material by electrostatic spraying, dip coating or the like.

Such a fixing roller, however, has had a problem that it may cause a phenomenon of electrostatic offset in which the toner held on the recording material is electrostatically transferred to the fixing roller, resulting in a low image quality level.

Because of triboelectric charging taking place between the recording material and the fixing roller or because of transfer electric charges accumulated on the recording material, an electric field through which the toner on the recording material is attracted to the fixing roller is produced, so that a part of the toner image is transferred onto the fixing roller. After the fixing roller is rotated once, the toner thus transferred is fixed to the recording material to become a ghost on the image. This is called "electrostatic offset".

The electrostatic offset is roughly grouped into two types, whole-area offset and release offset. The whole-area offset is a phenomenon where the recording material and the fixing member such as the fixing roller give and take electric charges mutually through triboelectric charging to cause an offset electric field steadily and the offset appears over the whole image area continuously. Meanwhile, the release offset is a phenomenon where the recording material hops at its rear end to come into strong contact with the fixing roller when the rear end of the recording material goes through the fixing assembly, so that it leaves potential history linearly on the fixing roller in its longitudinal direction, which potential causes an offset, and on the image the offset appears linearly in the principal scanning direction. Thus, the both are distinguishable.

To prevent such electrostatic offsets, in conventional apparatus the potential of the fixing roller is controlled at a constant value. Stated specifically, where a negatively chargeable toner is used, the fixing roller is subjected to antistatic treatment so as not to be positively charged, or is set electrically conductive and grounded so as to be made to have a potential of 0 V.

In an experiment, surface potential of the surface layer of such a fixing roller was measured with a surface potentiometer during paper feeding, to find that the surface layer stood charged only at tens of V even during paper feeding, thus an antistatic effect was confirmed.

Meanwhile, as image quality and process speed of electrophotographic apparatus have been made higher in recent years, a phenomenon called "smeared image trailing edges" (reading "smeared image-trailing-edges"; also "bleeding images") has come to occur conspicuously, in which a part of horizontal-line images diffuses toward its rear end side to become broken when the horizontal-line images are fixed. The cause of such smeared image trailing edges is presumed to be chiefly the pressure ascribable to steam generated from the interior of paper. The phenomenon of smeared image trailing edges is detailed here with reference to FIG. 6.

As shown in FIG. 6, steam having spouted at a space between a fixing roller 10 and a recording material 21 flows in the direction of an arrow and is compressed between the fixing roller 10, the recording material 21 and a toner image 41 to disorder the toner image 41.

As one of countermeasures for the smeared image trailing edges, it is proposed to provide a means for applying a bias voltage to the fixing roller 10. FIG. 7 shows an example of construction provided with such a bias-applying means (or bias power source) 12 as an example of countermeasures for the smeared image trailing edges.

As shown in FIG. 7, a fixing roller 10 has a fixing roller mandrel 10*a* formed in a hollow roll, and a releasing layer 10*b* which covers the periphery of the fixing roller mandrel 10*a*. To the fixing roller mandrel 10*a*, a DC bias of about 500 to 1,000 V is applied from the bias power source 12. Here, a resistance element (not shown) of several M Ω to tens of M Ω is provided as safety resistance across the bias power source 12 and the fixing roller mandrel 10*a*.

By the aid of an electric field generated by this bias, the toner image on the recording material 21 is electrostatically strongly held on the recording material 21 when the recording material 21 rushes into a fixing nip 31. In this state, the recording material 21 with the toner image is held between the fixing roller 10 and a pressure roller 11 and transported therethrough. Hence, the smeared image trailing edges can be prevented from occurring on the recording material 21 even when the flow of steam as stated above is produced.

In the construction where the bias-applying means is provided as a countermeasure for the smeared image trailing edges, it is important to produce an electric field across the toner image 41 and the back of the recording material 21 through the recording material 21, which electric field attracts the toner to the part of the recording material 21. Accordingly, in such construction, a transport roller (not shown) serving as a contact member which comes into contact with the recording material 21 is provided immediately behind the fixing nip 31, and this roller is set electrically conductive and grounded so that the voltage applied to the fixing roller 11 causes an electric current through the recording material 21 to produce the electric field across the toner image 41 and the back of the recording material 21.

Here, any too low resistance of the fixing roller 10 may cause an increase in the voltage allotted to the safety resistance to lower the voltage that contributes to the formation of the electric field across the fixing roller 10 and the back of the recording material 21, so that the effect of preventing the smeared image trailing edges may lower.

In the controlling of resistance values of the fixing roller 10 by dispersing carbon or a charge controlling agent therein as conventionally done, the resistance values of the fixing roller may greatly change depending on the viscosity of a coating solution used when the fixing roller 10 is manufactured, its pH value, the state of dispersion of carbon or charge control agent therein and its changes with time. Thus, it has not been easy to control the resistance values of the fixing roller 10 to a constant value.

Moreover, even where carbon is dispersed in the fixing roller 10 in a small quantity, the fixing roller 10 can not easily be made to have a low surface resistivity. Accordingly, in order to make its surface resistivity low enough to attain the effect of preventing the electrostatic offset, the carbon must be dispersed in a large quantity. However, dispersing the carbon in a large quantity may make the fixing roller 10 have a very low volume resistivity. Hence, any effect of preventing smeared image trailing edges can not be attained, and it has been difficult to ensure a sufficient image quality.

As disclosed in Japanese Patent Application Laid-open No. 2000-19879, a heat fixing roller is proposed in which the releasing layer is formed in a multilayer and a filler is dispersed in each layer. In such construction, the fixing roller can be made to have a proper volume resistivity but can not easily be made to have a low surface resistivity. Thus, there is room for further improvement in proofness to electrostatic offset (i.e., anti-offset properties). In addition, a filler having a low powder resistivity may cause a great change in volume resistivity, making it difficult to control volume resistivity.

Accordingly, it has been long awaited to provide a method by which the releasing layer at the surface of the fixing roller 10 is made only to have a low surface resistivity without being made to have a low volume resistivity.

SUMMARY OF THE INVENTION

An object of the present invention is to provide a fixing member having solved the above problems, a fixing assembly having such a fixing member and an image-forming apparatus having the fixing assembly.

Another object of the present invention is to provide a fixing member which can stably be made to have a low surface resistivity and has superior anti-offset properties and proofness to smeared image trailing edges, a fixing assembly having such a fixing member and an image-forming apparatus having the fixing assembly.

To achieve the above objects, the present invention provides a fixing member for use in a fixing assembly, wherein the fixing assembly has at least the fixing member and a pressure member coming into pressure contact with the fixing member to form a fixing nip, where a recording material holding an unfixed toner image thereon is passed through the fixing nip so as to fix the unfixed toner image to the recording material to form a fixed imaged on the recording material;

the fixing member comprising a conductive layer and a releasing layer formed on the conductive layer, wherein;

in the releasing layer, any one or both of medium-resistance particles and medium-resistance whiskers are dispersed; and the releasing layer has a surface resistivity of $1.0\times10^8$ Ω or below and a volume resistivity of $1.0\times10^8$ Ωcm or above.

The present invention also provides a fixing assembly comprising a fixing member and a pressure member coming into pressure contact with the fixing member to form a fixing nip, wherein;

a recording material holding an unfixed toner image thereon is passed through the fixing nip so as to fix the unfixed toner image to the recording material to form a fixed imaged on the recording material; and the fixing member comprises a conductive layer and a releasing layer formed on the conductive layer, wherein;

in the releasing layer, any one or both of medium-resistance particles and medium-resistance whiskers are dispersed; and the releasing layer has a surface resistivity of $1.0\times10^8$ Ω or below and a volume resistivity of $1.0\times10^8$ Ωcm or above.

The present invention still also provides an image-forming apparatus comprising:

an image-bearing member for holding thereon an electrostatic latent image;

a charging means for charging the surface of the image-bearing member electrostatically;

an electrostatic latent image forming means for forming an electrostatic latent image on the surface of the image-bearing member thus charged;

a developing means having a developer and by which the electrostatic latent image formed on the image-bearing member is developed to form a toner image;

a transfer means for transferring the toner image onto a recording material; and a fixing assembly by means of which the toner image transferred onto the recording material and standing unfixed is fixed to form a fixed image;

wherein;

the fixing assembly comprises a fixing member and a pressure member coming into pressure contact with the fixing member to form a fixing nip, wherein;

a recording material holding an unfixed toner image thereon is passed through the fixing nip so as to fix the unfixed toner image to the recording material to form a fixed imaged on the recording material; and the fixing member comprises a conductive layer and a releasing layer formed on the conductive layer, wherein;

in the releasing layer, any one or both of medium-resistance particles and medium-resistance whiskers are dispersed; and the releasing layer has a surface resistivity of $1.0\times10^8$ Ω or below and a volume resistivity of $1.0\times10^8$ Ωcm or above.

DETAILED DESCRIPTION OF THE PREFERRED EMBODIMENTS

Figure 1:
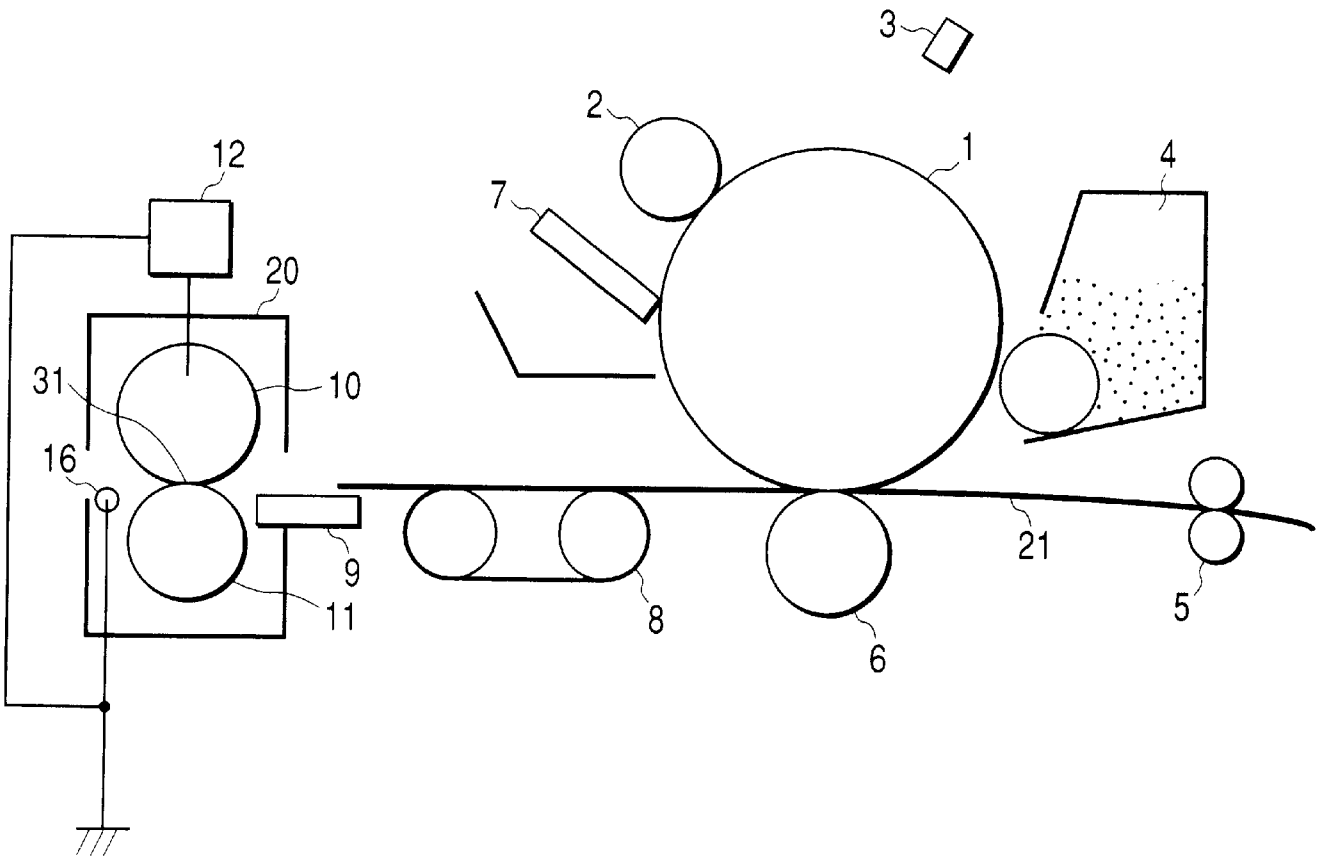
FIG. 1 is a schematic side view of an image-forming apparatus in a first example of the present invention.

The fixing member of the present invention comprises a conductive layer and a releasing layer formed on the conductive layer. In the releasing layer, medium-resistance particles and/or medium-resistance whiskers are dispersed. The releasing layer has a surface resistivity of $1.0\times10^{8}$ Ω or below and a volume resistivity of $1.0\times10^{8}$ Ωcm or above.

In the fixing member of the present invention, the part of the medium-resistance particles and/or medium-resistance whiskers contained in the releasing layer serves as leak sites, which can lower the surface resistivity of the fixing member to a level within a specific range and also can make its volume resistivity not unnecessarily small to keep it within a specific range, without dispersing any conductive agent or antistatic agent in the releasing layer of the fixing assembly. Thus, it becomes possible to provide a fixing member having superior anti-offset properties and proofness to smeared image trailing edges.

The medium-resistance particles and the medium-resistance whiskers may have a powder resistivity of from $1.0\times10^{1}$ to $1.0\times10^{12}$ Ωcm. This can provide a fixing member having more superior anti-offset properties and proofness to smeared image trailing edges. Also, this resistivity is preferable in order to control the resistance values of the releasing layer.

The medium-resistance particles and the medium-resistance whiskers may have a powder resistivity of from $1.0\times10^{3}$ to $1.0\times10^{9}$ Ωcm. This can provide a fixing member having much more superior anti-offset properties and proofness to smeared image trailing edges. Also, this resistivity is more preferable in order to control the resistance values of the releasing layer.

The medium-resistance particles and the medium-resistance whiskers may have surfaces having been subjected to hydrophilic treatment. This enables ions to be trapped to the particle surfaces and the vicinity thereof to lower the surface resistivity more effectively, and is more preferable in order to achieve both anti-offset properties and proofness to smeared image trailing edges.

The medium-resistance whiskers may be whiskers of a metal oxide. This can improve strength of the releasing layer of the fixing member and can improve resistance to wear simultaneously. Thus, a fixing member having superior anti-offset properties and proofness to smeared image trailing edges can be provided.

The medium-resistance whiskers may be metal oxide whiskers whose surfaces have been subjected to hydrophilic treatment. This can provide a fixing member having superior anti-offset properties and proofness to smeared image trailing edges.

The medium-resistance particles may be titanium oxide particles whose surfaces have been subjected to hydrophilic treatment. This can provide a fixing member having superior anti-offset properties and proofness to smeared image trailing edges.

The medium-resistance particles and/or the medium-resistance whiskers may be contained in the releasing layer in a total amount of from 5 to 50% by weight based on the weight of the releasing layer. This is preferable in order to form a releasing layer having suitable surface resistivity and volume resistivity when the fixing member having superior anti-offset properties and proofness to smeared image trailing edges is provided.

The releasing layer may contain any one or both of the medium-resistance particles and the medium-resistance whiskers and a fluorine resin. This is preferable in order to form a releasing layer having superior release properties and resistance to heat when a fixing member having achieved both anti-offset properties and proofness to smeared image trailing edges is provided.

The releasing layer may be so formed as to have a surface resistivity of from $1.0\times10^{3}$ to $1\times10^{8}$ Ω and a volume resistivity of from $1.0\times10^{8}$ to $1\times10^{15}$ Ωcm. This is more preferable in order to provide the fixing member having achieved both anti-offset properties and proofness to smeared image trailing edges.

The releasing layer may have a layer thickness of from 1 to 45 μm. This enables formation of a releasing layer having well balanced mechanical strength and heat transfer properties when the fixing member having achieved both anti-offset properties and proofness to smeared image trailing edges is provided.

The releasing layer may have a layer thickness of from 3 to 30 μm. This is more preferable in order to form a releasing layer having well balanced mechanical strength and heat transfer properties when the fixing member having achieved both anti-offset properties and proofness to smeared image trailing edges is provided.

The fixing member may be formed in the form of a roll. This is preferable in order to achieve a higher process speed of the apparatus when the fixing member having achieved both anti-offset properties and proofness to smeared image trailing edges is provided.

The fixing member may be formed in the form of a belt or a film. This is preferable in order to provide a fixing member having a higher heat transfer efficiency when the fixing member having achieved both anti-offset properties and proofness to smeared image trailing edges is provided.

According to the fixing assembly of the present invention, which has the fixing member described above, it becomes possible to achieve both anti-offset properties and proofness to smeared image trailing edges.

In the fixing assembly, a potential difference may be provided between the releasing layer and the conductive layer. This is more preferable in order to provide a fixing assembly having achieved both anti-offset properties and proofness to smeared image trailing edges.

According to the image-forming apparatus of the present invention, which has the fixing assembly described above, it becomes possible to achieve both anti-offset properties and proofness to smeared image trailing edges.

Embodiment of the present invention are described below in greater detail.

The fixing member of the present invention is a fixing member having a releasing layer in which any one or both of medium-resistance particles and medium-resistance whiskers are dispersed so that they may cause insulation failure at the surface of the releasing layer coming into contact with the recording material at the time of fixing, to form leak sites in the releasing layer so as to lower the surface potential of the releasing layer to attain an anti-offset effect sufficiently and also so as to keep the volume resistivity of the releasing layer at a stated value or above to ensure proofness to smeared image trailing edges.

Accordingly, there are no particular limitations on its form as long as it is a member which comes into contact with the recording material to fix unfixed toner images held on the recording material. For example, it may be a fixing member whose releasing layer moves synchronizingly with the recording material, or may be a fixing member whose releasing layer is set stationarily to, and comes into slidable contact with, the recording material. Such a fixing member may have any form including, e.g., the form of a roll, the form of a belt and the form of a film. Thus, any form may be used which is conventionally known as the form the fixing member may have. A fixing member having the form of a roll can have a relatively large heat capacity and is advantageous for higher process speed. A fixing member having the form of a belt or film is advantageous for the improvement in energy efficiency of the apparatus because of an improvement in heat transfer effeciency.

As for the conductive layer, there are no particular limitations thereon as long as it has a good conductivity. It may be a layer formed in a stated form using a conductive material, or may be a layer formed on a substrate (conductive or non-conductive) by any known means such as vacuum deposition, dip coating or spray coating. The conductive material that forms such a conductive layer can be exemplified by non-magnetic conductive materials such as aluminum, stainless steel and copper, magnetic conductive materials such as iron, and conductive plastics. The "layer" herein referred to is meant to be one of what forms superposition, and there are no particular limitations on its form.

In the releasing layer, any one or both of the medium-resistance particles and the medium-resistance whiskers are dispersed, and this layer is the outermost layer coming into contact with the recording material at the time of fixing. Accordingly, the releasing layer may preferably have a good releasability to the recording material and the toner image formed on the recording material. To form such a releasing layer, a conventionally known resin or rubber may be used. The resin or rubber can be exemplified by fluorine resins or fluorine rubbers having a good releasability, such as polytetrafluoroethylene copolymers and perfluoroalkoxytetrafluoroethylene copolymers. Any of these resins or rubbers may be used alone or in combination of two or more types.

The releasing layer may preferably have a layer thickness of 1 to 45 $\mu$m, and more preferably from 3 to 30 $\mu$m, from the viewpoint of durability and fixing-assembly thermal efficiency. If the releasing layer has a layer thickness smaller than 1 $\mu$m, the releasing layer tends to abrade or come off as a result of repetition of paper feeding. This is not preferable in view of durability. If on the other hand the releasing layer has a layer thickness larger than 45 $\mu$m, the releasing layer may function as a heat insulation layer. This is not preferable in view of thermal efficiency. The layer thickness of the releasing layer may be controlled in the course of the formation of the layer. The layer thickness of the releasing layer formed may be measured with, e.g., a layer thickness meter such as a micrometer.

On the medium-resistance particles and medium-resistance whiskers, there are no particular limitations as long as they are particles or whiskers that cause insulation failure at the surface of the releasing layer during charging to form leak sites where the medium-resistance particles and/or the medium-resistance whiskers stand as nuclei. Such medium-resistance particles and medium-resistance whiskers may include metal oxides and ceramics. Stated specifically, they can be exemplified by titanium oxide, zinc oxide, tin oxide, indium oxide, alumina, barium titanate, silicon carbide, silica, glass beads and carbon fluoride. The medium-resistance particles may have any shape such as spherical or amorphous. The medium-resistance whiskers may also have any shape such as acicular, tetrapod, two-dimensional or three dimensional.

The medium-resistance particles and the medium-resistance whiskers may preferably have a powder resistivity of from $1.0\times10^{1}$ to $1.0\times10^{12}$ Ωcm, and more preferably from $1.0\times10^{3}$ to $1.0\times10^{9}$ Ωcm. This is advantageous from the viewpoint of forming the leak sites efficiently and controlling the volume resistivity and the surface resistivity independently. If the medium-resistance particles and the medium-resistance whiskers have a powder resistivity lower than $1\times10^{1}$ Ωcm, like the conductive particles such as carbon the releasing layer tends to come to have a very low volume resistivity when the particles are dispersed in a quantity large enough to lower the surface resistivity. This is not preferable in view of proofness to smeared image trailing edges. If the medium-resistance particles and the medium-resistance whiskers have a powder resistivity higher than $1.0\times10^{12}$ Ωcm, they may have too small a difference in resistance from that of releasing layer resin to cause the insulation failure in the releasing layer, so that any leak sites can not effectively be formed and hence the fixing roller can not be made to have a sufficiently low surface resistivity. This is not preferable in view of anti-offset properties.

The powder resistivity of the medium-resistance particles and medium-resistance whiskers is determined by measuring the direct-current resistance of a sample powder having been molded at a pressure of 100 kg/cm$^2$ into a disk-like compressed powder (diameter: 18 mm; thickness: 3 mm), and calculated from the following expression.

$$\text{Powder resistivity}=\text{measured value}\times 2.54/\text{thickness}$$

(In the expression, 2.54 indicates an electrode constant, and the unit of thickness is cm.)

The medium-resistance particles and the medium-resistance whiskers may preferably be those having a primary or secondary particle diameter larger than the thickness of the releasing layer in order to lower the surface potential of the releasing layer. The medium-resistance particles and the medium-resistance whiskers may also preferably have a particle shape more deformed than a spherical particle, and may preferably have, e.g., an aspect ratio, the ratio of length to breadth of a particle (length/breadth ratio), of from 10 to 40. If they have an aspect ratio smaller than 10, they may have a small predominance to spherical particles. If they have an aspect ratio larger than 40, the whiskers may be broken at the time of dispersion to make it difficult to lower the surface potential of the fixing member in a good efficiency.

The medium-resistance particles and the medium-resistance whiskers may be those whose surfaces have been subjected to hydrophilic treatment. This brings about the effect of lowering the surface resistivity of the releasing layer more effectively. In this hydrophilic treatment, like that conventionally made on usual pigment titanium oxide or ultrafine titanium oxide particles, their surfaces may be coated with a hydrous oxide, and/or an oxide, of at least one selected from the group consisting of Al, Si, Zr, Sn, Ti and Zn. Their surfaces may also be coated with an organic matter of at least one selected from the group consisting of a silicone compound and a polyol compound. Also, as other methods for the hydrophilic treatment, it may include physical treatment such as plasma treatment, ion beam treatment or ultraviolet radiation treatment, and chemical treatment such as treatment with chemicals by using an acid or an alkali and treatment with solvents by using an organic solvent. In the present invention, two or more of these methods for hydrophilic treatment may be used in combination.

As the medium-resistance whiskers, the use of whiskers of metal oxides is preferred from the viewpoint of the strength and powder resistivity of the medium-resistance whiskers and the shape that satisfies the above aspect ratio. Use of whiskers of metal oxides which have been subjected to hydrophilic treatment is more preferred from the viewpoint of lowering the surface resistivity in a good efficiency.

The releasing layer may be formed by any method without any particular limitations as long as a releasing layer having a preferable layer thickness can be formed on the conductive layer. It may be formed by covering the conductive layer with a sheet-like or tubular releasing layer or by bonding the latter to the former. Alternatively, it may be formed by conventionally known coating such as electrostatic spraying or dip coating, or by coating similar thereto.

The surface resistivity and volume resistivity of the releasing layer may differ depending on the types of the resin or rubber and medium-resistance particles used and the quantity in which the medium-resistance particles are dispersed. Accordingly, when the releasing layer is formed, it is preferable to appropriately determine preferable combination and mixing amount in accordance with the type of the resin or rubber, the type(s) of the medium-resistance particles and/or medium-resistance whiskers used and the size and particle shape of the medium-resistance particles and/or medium-resistance whiskers used, to form the releasing layer so as to have the preferable resistivities, i.e., the surface resistivity of $1.0\times10^8$ Ω or below and the volume resistivity of $1.0\times10^8$ Ωcm or above.

The medium-resistance particles and/or the medium-resistance whiskers may preferably be dispersed in the releasing layer in an amount ranging from 5 to 50% by weight, and more preferably from 10 to 40% by weight, in total, based on the weight of the releasing layer. If the medium-resistance particles and/or the medium-resistance whiskers are dispersed in an amount more than the above upper limit, the leak sites are in so large a number as to greatly affect not only the surface resistivity but also the volume resistivity to cause a lowering of volume resistivity. This is not preferable from the viewpoint of proofness to smeared image trailing edges. Moreover, the releasing layer may come to have low surface properties to tend to cause toner adhesion. This is not preferable also from the viewpoint of anti-offset properties. If on the other hand the the medium-resistance particles and/or the medium-resistance whiskers are dispersed in an amount less than the above lower limit, the leak sites can not sufficiently be formed and the releasing layer can not be made to have a low surface resistivity. This is not preferable from the viewpoint of anti-offset properties.

In the present invention, when the releasing layer is formed, other materials such as carbon and conductive particles may be mixed in a small quantity in such a range that, e.g., they do not lower the volume resistivity extremely.

According to the releasing layer described above, since the surface resistivity can be made lower than the volume resistivity in the releasing layer, the phenomenon of offset stated previously can be prevented. In this case, the releasing layer may have a surface resistivity of $1.0\times10^8$ Ω or below, and preferably from $1.0\times10^3$ to $1.0\times10^8$ Ω. Also, since the volume resistivity can be made higher than the surface resistivity in the releasing layer, the smeared image trailing edges stated previously can be prevented. In this case, the releasing layer may have a volume resistivity of $1.0\times10^8$ Ωcm or above, and preferably from $1.0\times10^8$ to $1.0\times10^{15}$ Ωcm. If the surface resistivity and volume resistivity of the releasing layer turn aside from the above condition, it may be difficult to prevent at least one of the offsetting and the smeared image trailing edges, so that images with a good quality may be obtained with difficulty.

In the present invention, the surface resistivity is meant to be the value of resistance between opposing two sides of a square having each side in a unit length (1 cm); the square being assumed on the releasing layer surface. The unit of surface resistivity is commonly given in the ohm per square (Ω/square). In the present invention, however, it is expressed as the ohm (Ω) according to JIS K6911.

The volume resistivity is also the value of resistance between opposing two faces of a cube having each side in a unit length (1 cm); the cube being assumed in the interior of the releasing layer. As the unit, it is expressed as the ohm centimeter (Ωcm).

The surface resistivity and volume resistivity of the releasing layer can be measured, e.g., in the following way: Using a circular electrode having a disk-type main electrode and a ring electrode surrounding the main electrode leaving an interval of about 9.5 mm, a sample prepared previously by forming a releasing layer on polyethylene terephthalate (PET) film is contact-bonded to this circular electrode to make measurement with a resistance meter (4329A, manufactured by Hewlett-Packard Co.) in an environment of 23° C. and 60% RH under application of a voltage of 10 V across the main electrode and the ring electrode.

The fixing assembly of the present invention is a unit having the fixing member described above and a pressure member, where a recording material having an unfixed toner image formed thereon is passed through a fixing nip formed by mutual pressure contact of these members to fix the unfixed toner image on the recording material as a fixed image.

The fixing assembly may have any form without any particular limitations as long as the unfixed toner image can be fixed onto the recording material. It may employ a system in which a bias voltage is applied at the time of fixing as described previously, or a conventionally known fixing system such as heat roll fixing, fixing using a film or pressure fixing, or a fixing system in which some of these fixing systems are combined.

In addition to the fixing member and the pressure member, the fixing assembly may have various devices suited for any fixing system to be employed. Such devices may include, e.g., a heating element (a heating resistor) for causing the toner to melt-adhere to the recording material at the time of fixing, a power source for applying the bias voltage, a resistance element for controlling the application of the bias voltage, and guide means for guiding the feed or delivery of the recording material to or from the fixing assembly.

The fixing assembly may also be so constructed as to be provided with a potential difference between the releasing layer and the conductive layer of the fixing member by using the power source and the resistance element. This enables surface potential and internal potential to be stably generated in the releasing layer at the time of fixing, and is preferable in order to prevent the offsetting and the smeared image trailing edges.

The pressure member may have any form without any particular limitations as long as it can form the fixing nip between it and the fixing member and can bring the recording material into pressure contact with the fixing member at the fixing nip to such an extent that the toner can sufficiently be fixed to the recording material by the fixing member. Such a pressure member may be pressed against the fixing member by, e.g., pressure produced by pressing with a spring member such as a coil spring, or pressure produced by elasticity of a spongy elastic body formed using a resin or rubber. The pressing of the pressure member may be controlled by, e.g., controlling a pressing force of a pressing means, or adjusting the relative positional relation to the fixing member.

The image-forming apparatus of the present invention is an image-forming apparatus having the fixing assembly described above, and may have any form without any particular limitations as long as it is an image-forming apparatus having an image-bearing member for holding thereon an electrostatic latent image, a charging means for charging the surface of the image-bearing member electrostatically, an electrostatic latent image forming means for forming an electrostatic latent image on the surface of the image-bearing member thus charged, a developing means having a developer and by which the electrostatic latent image formed on the image-bearing member is developed to form a toner image, a transfer means for transferring the toner image onto a recording material, and a fixing assembly by means of which the toner image transferred onto the recording material and standing unfixed is fixed to form a fixed image.

As an image forming method employed in the image-forming apparatus of the present invention, it may be a system in which an electrostatic latent image is developed with a developer to form a toner image and this toner image is fixed onto a recording material. As the image-forming method of such a system, conventionally known image-forming systems may be employed, as exemplified by an electrophotographic system in which an electrostatic latent image is made to be held on an image-bearing member, the electrostatic latent image is developed with a developer to form a toner image, this toner image is transferred to a recording material and the toner image transferred to the recording material is fixed by means of a fixing assembly, and an electrostatic recording system in which an electrostatic latent image is formed on a recording material, the electrostatic latent image is developed with a developer to form a toner image and this toner image is fixed to the recording material.

The image-forming apparatus of the present invention may have any form having construction sufficient, or preferable, for carrying out the image-forming system described above. Any construction conventionally known in variety may be used as such construction.

The present invention is described below by giving Examples and with reference to the accompanying drawings. The present invention is by no means limited to the following Examples.

EXAMPLE 1

Example 1 of the present invention is described with reference to FIGS. 1 and 2. FIG. 1 is a schematic side view of an image-forming apparatus in Example 1 of the present invention.

The image-forming apparatus of the present Example is an image-forming apparatus of an electrophotographic system. It has a photosensitive drum 1 which is an image-bearing member which holds an electrostatic latent image on its surface; a charging assembly 2 which is a charging means for charging the photosensitive drum 1 uniformly negatively; an exposure means 3 which is an electrostatic latent image formation means for exposing to light the photosensitive drum 1 thus charged, to form the electrostatic latent image; a developing assembly 4 as a developing means for feeding a toner of a developer onto the photosensitive drum 1 to render the electrostatic latent image visible; a transfer roller 6 which is a transfer means for transferring a toner image, the electrostatic latent image rendered visible, to a recording material 21 such as paper; a registration roller 5 which is a recording material feed means consisting of a pair of rollers and interposingly transporting the recording material to the transfer roller 6; a blade 7 which is a cleaning means for removing transfer residual toner remaining on the photosensitive drum 1 after transfer; a transport system 8 for transporting to the next stage the recording material 21 holding the toner image thereon; and a fixing assembly 20 which is a roller-type heat fixing assembly for fixing the toner image onto the recording material 21.

Figure 2:
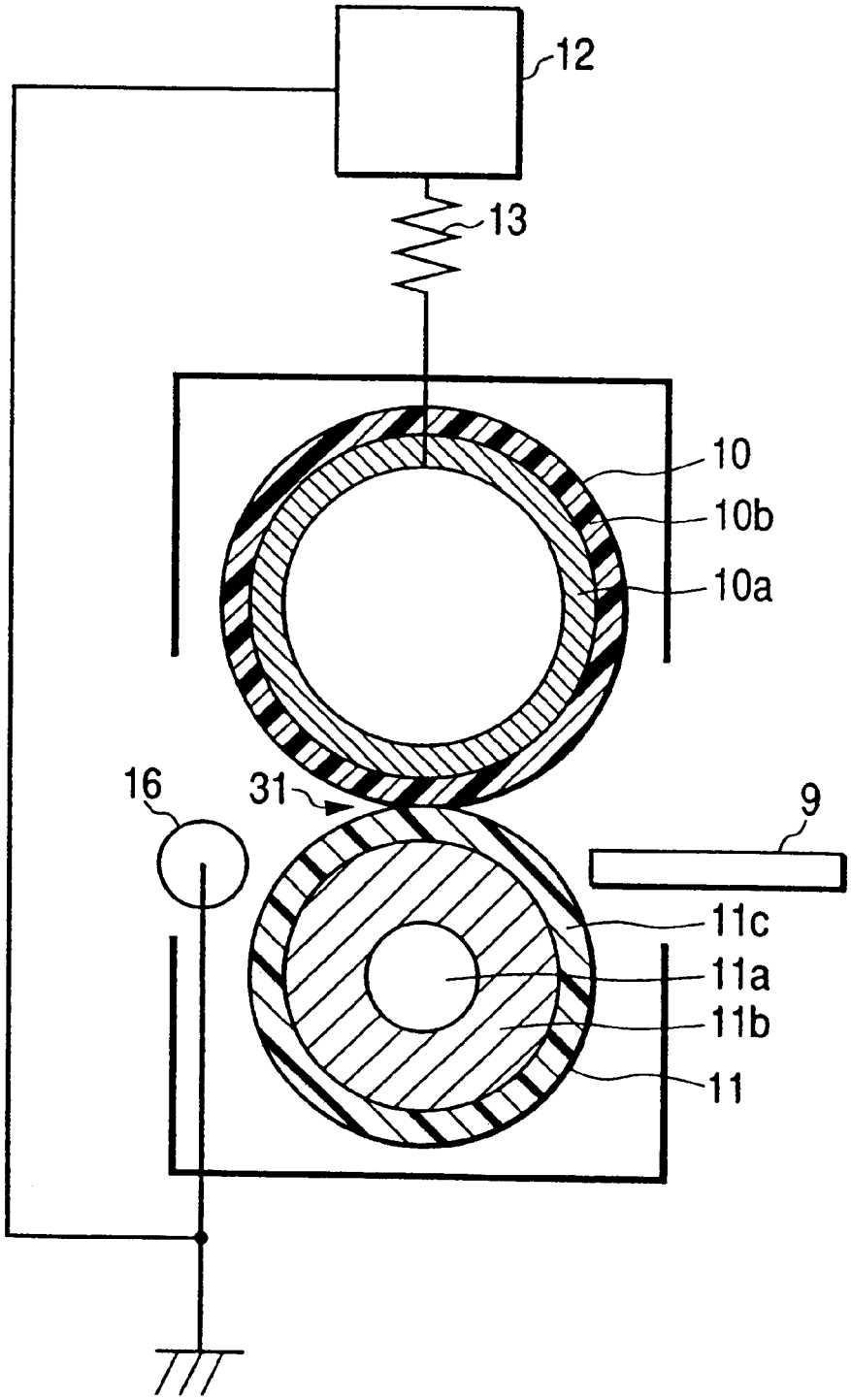
FIG. 2 is a schematic view of a fixing assembly in the first example of the present invention.

FIG. 2 is a schematic view of the roller-type heat fixing assembly in the present Example.

The fixing assembly 20 has a fixing roller 10 and a pressure roller 11 which are provided in pressure contact with each other to form a fixing nip 31, and a resistance element 13 provided between a power source 12 and the fixing roller 10 to connect the both. On the side upstream to the fixing nip 31, an entrance guide plate 9 is provided which sets the position at which the recording material enters the fixing nip 31 to prevent paper from wrinkling. On the side downstream to the fixing nip 31, a transfer roller 16 is provided so as to guide the recording material 21 from the fixing nip 31 to a paper output tray (not shown). The transfer roller 16 is formed of a conductive plastic, and is grounded.

The fixing roller 10 is constructed as detailed below.

The fixing roller 10 comprises, e.g., an aluminum cylinder 10*a* of 30 mm in external diameter and 2 mm in wall thickness and provided thereon a releasing layer 10*b* formed of a fluorine resin in a thickness of about 10 $\mu$m. In the interior, it is also provided with a halogen heater (not shown) as a heating element, which heats the fixing roller 10 under preset control so as to have a proper temperature. The aluminum cylinder 10*a* is further connected to the bias power source 12 so that a voltage of −500 V can be applied from the bias power source 12.

The releasing layer 10*b* is, e.g., a layer formed of a polytetrafluoroethylene copolymer (PTFE) and a perfluoroalkoxytetrafluoroethylene copolymer (PFA), having an excellent performance for releasability, which are mixed in a proportion of 7:3.

Stated in greater detail, the releasing layer 10*b* is a layer formed in a thickness of about 10 $\mu$m by dip-coating the aluminum cylinder 10*a* with an aqueous dispersion (water-based dispersion), followed by drying and then baking; the aqueous dispersion being prepared by mixing the PTFE and the PFA in a proportion of 7:3 and further mixing therewith 30% by weight of medium-resistance particles titanium oxide particles. As the titanium oxide particles, used were titanium oxide particles having an average particle diameter of 0.4 $\mu$m and whose surfaces had been subjected to hydrophilic treatment with $Al_2O_3$. The present titanium oxide particles had a powder resistivity of $0.9\times10^9$ Ωcm.

The releasing layer 10*b* controls the surface resistivity of the fixing roller 10 by the aid of the titanium oxide particles dispersed in the copolymer mixture. The surface resistivity and volume resistivity of this fixing roller 10 were measured to find that the surface resistivity was $1.5\times10^{7}$ Ω and the volume resistivity was $8.2\times10^{13}$ Ωcm.

The pressure roller 11 has an external diameter of 24 mm, and comprises a mandrel 11*a* of 12 mm in external diameter and provided thereon an elastic layer 11*b* formed of a conductive silicone sponge; the pressure roller being provided in pressure contact with the fixing roller 10 so as to form the fixing nip 31 to an extent necessary for providing a sufficient amount of heat for fixing. Also, the pressure roller 11 has an outermost layer formed of a 30 μm thick PFA tube 11*c*, so as to be improved in releasability.

The image-forming apparatus in the present Example is driven and operated as described below.

The photosensitive drum 1 is uniformly charged by means of the charging assembly 2, and a latent image is formed on the surface of the photosensitive drum 1 through the exposure means 3. This latent image is reverse-developed by means of the developing assembly 4 having a negatively chargeable toner, and is rendered visible as a toner image. Then, the toner image is transferred by means of the transfer roller 6 onto the recording material 21 transported interposingly by the registration roller 5. Thereafter, the photosensitive drum 1 is cleaned by the blade 7, and is made ready for the next steps of image formation.

Meanwhile, the recording material 21 holding the toner image thereon by transfer passes the transport system 8 and the entrance guide plate 9, and is guided to the part between the fixing roller 10, having a heating source (not shown) in its interior, and the pressure roller 11, where it is heated and pressed while being interposingly transported through the fixing nip between the both rollers, thus the toner image is fixed.

In the fixing roller 10, the heating element halogen heater (lamp) mentioned above is electrified from a power source (not shown) so that the heat sufficient for melting the toner on the recording material 21 can be applied from the interior of the aluminum cylinder 10*a*.

Anti-offset properties and proofness to smeared image trailing edges were evaluated using the fixing assembly 20 having the fixing roller 10. As a pattern for evaluating the proofness to smeared image trailing edges, a test pattern was used in which a horizontal-line image having a 4-dot width of 600 dpi was repeatedly drawn at intervals of 27 dots. Also, as a pattern for evaluating the anti-offset properties, a test pattern was used in which a vertical-line image having a 4-dot width of 600 dpi was repeatedly drawn at intervals of 27 dots. Still also, as practical images, images were reproduced using a pattern having a table and a photographic picture in combination. As the result, good results were obtainable on both the anti-offset properties and the proofness to smeared image trailing edges. The reason why such good results were obtained was considered attributable to the surface potential made low in the releasing layer 10*b* and the internal potential maintained in the releasing layer 10*b*. This mechanism is explained below.

Figure 8:
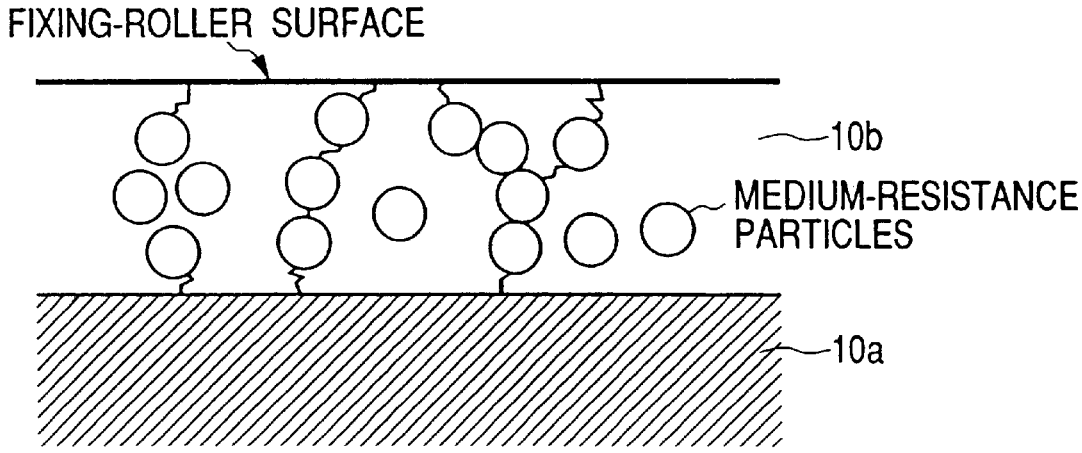
FIG. 8 illustrates the mechanism by which the surface potential of a fixing roller in the first example lowers.

How the surface potential lowers in the fixing member of the present invention is explained with reference to FIG. 8. As shown in FIG. 8, any accumulation of electric charges on the surface of the fixing roller 10 causes insulation failure between the medium-resistance particles in the releasing layer 10*b* and the surface of the releasing layer, so that the leak sites where the medium-resistance particles stand as nuclei are formed. This occurs because the releasing layer has a volume resistivity of $10^{14}$ Ωcm or above and stands substantially perfectly insulative, whereas the medium-resistance particles have a resistance lower than insulation properties and have a resistance low enough to cause a difference in resistance from that of the releasing layer, and hence the electric charges tend to flow to the part of the medium-resistance particles.

This makes the releasing layer 10*b* have a low surface potential at the part where the medium-resistance particles stand as nuclei, and brings about the action to lower the whole surface potential of the releasing layer 10*b*. This appears as the lowering of surface resistivity of the releasing layer 10*b*.

In order for the medium-resistance particles to have the action to form the leak sites, it is advantageous for their particle diameter to be as large as possible. Even if their primary particles have a small diameter, they can attain the like effect when their secondary particles have a sufficiently large diameter.

The insulation failure attributable to the medium-resistance particles takes place at the surface of the releasing layer 10*b*, and hence it only lowers the surface potential of the releasing layer 10*b* and does not so much affect the volume resistivity of the releasing layer 10*b*. Hence, the volume resistivity of the releasing layer 10*b* is kept at a preset value.

Moreover, the titanium oxide particles used in the present Example have surfaces having preferably been subjected to hydrophilic treatment. This surface hydrophilic treatment enables ions to be trapped to the particle surfaces to make electric charges move with ease. Thus, this treatment has the function to further lower the surface resistivity.

EXAMPLE 2

In the present Example, as the medium-resistance whiskers, zinc oxide whiskers are used which have been subjected to hydrophilic treatment with alumina ($Al_2O_3$) like Example 1.

The zinc oxide whiskers used in the present Example are those having a length of 10 μm and an aspect ratio (ratio of length to breadth) of 20. Acicular fillers having a large aspect ratio like the zinc oxide whiskers used here can more readily form the leak sites than spherical particles, and their addition in an amount of about a half of the spherical particles brings about the like effect. Thus, the like effect can be attained by their addition in a smaller amount.

The zinc oxide whiskers used in the present Example had a powder resistivity of $1.8\times10^{8}$ Ωcm. In the present Example, a fixing roller 10 was produced in the same manner as in Example 1 except that the zinc oxide whiskers were dispersed in an amount of 15% by weight. The surface resistivity and volume resistivity of this fixing roller 10 were measured to find that the surface resistivity was $9.9\times10^{7}$ Ω and the volume resistivity was $1.7\times10^{13}$ Ωcm.

This fixing roller 10 was set in the same fixing assembly as that in Example 1, and anti-offset properties and proofness to smeared image trailing edges were evaluated in the same manner as in Example 1. As the result, in all cases, in the evaluation using the test patterns, the electrostatic offset occurred a little because of a surface resistivity which became larger than in Example 1, but was at a level of no problem in the evaluation using the practical images. Smeared image trailing edges were also at a level of no problem.

COMPARATIVE EXAMPLE 1

In the present Comparative Example, carbon black Ketjen Black was used as conductive particles in place of the medium-resistance particles used in Example 1.

In the present Comparative Example, a fixing roller 10 was produced in the same manner as in Example 1 except that Ketjen Black was dispersed in an amount of 3% by weight. The surface resistivity and volume resistivity of this fixing roller 10 were measured to find that the surface resistivity was $7.7\times10^5$ Ω and the volume resistivity was $1.3\times10^7$ Ωcm. The Ketjen Black had powder resistivity of less than $1.0\times10^0$ Ω.

This fixing roller 10 was set in the same fixing assembly as that in Example 1, and anti-offset properties and proofness to smeared image trailing edges were evaluated in the same manner as in Example 1. As the result, the offset was not at a preferable level, and occurred even at a level such that it was recognizable in practical images. This is because the Ketjen Black, when dispersed even in a small quantity, causes a great change in resistivity, so that the surface resistivity does not lower sufficiently at some part in minute regions, and hence, even though the surface resistivity is seen to have lowered on the whole, the surface is electrically charged at some part to attract the toner.

In addition, when the fixing roller of Comparative Example 1 was used, the smeared image trailing edges occurred at a serious level, and occurred at an untolerable level even in the practical images. This is because the volume resistivity of the fixing roller 10 has lowered, and hence the voltage allotted to the safety resistance has increased, so that the electric field formed across the fixing roller 10 and the back of the recording material 21 has weakened.

COMPARATIVE EXAMPLE 2

Like Comparative Example 1, Ketjen Black was used as conductive particles. In Comparative Example 2, a fixing roller 10 was produced in the same manner as in Example 1 except that Ketjen Black was dispersed in an amount of 1.5% by weight. The surface resistivity and volume resistivity of this fixing roller 10 were measured to find that the surface resistivity was $1.2\times10^8$ Ω and the volume resistivity was $9.9\times10^7$ Ωcm.

This fixing roller 10 was set in the same fixing assembly as that in Example 1, and levels at which the offset and the smeared image trailing edges occurred were examined. As the result, the smeared image trailing edges were at a level within tolerance, i.e., at a level such that the smeared image trailing edges were recognizable in the test patterns but little conspicuous in the practical images. However, the offset was at a serious level such that it was recognizable even in the practical images. This is because the Ketjen Black, when dispersed even in a small quantity, acts to lower the volume resistivity to a certain degree but can not form the leak sites, and hence the surface resistivity does not lower and the surface of the fixing roller becomes electrically charged.

COMPARATIVE EXAMPLE 3

Figure 9:
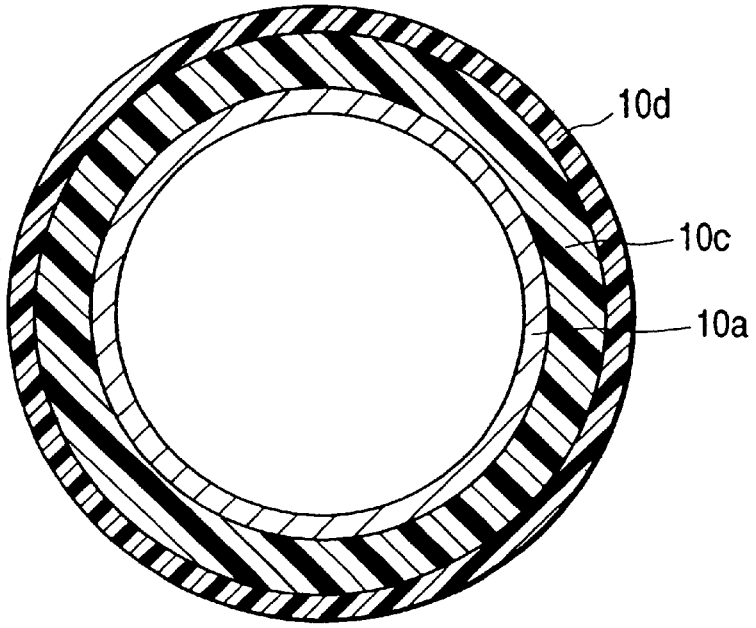
FIG. 9 is a schematic cross-sectional view of a fixing roller in a third comparative example of the present invention.

In Comparative Example 3, the same aluminum cylinder as that in Example 1 was used as a conductive substrate, and a releasing layer of multilayer construction was formed thereon. FIG. 9 is a schematic cross-sectional view of a fixing member of Comparative Example 3.

Like Example 1, the aluminum cylinder 10*a* was dip-coated with an aqueous dispersion (water-based dispersion) in a thickness of about 40 μm, followed by drying and then baking to form a first releasing layer 10*c;* the aqueous dispersion being prepared by mixing PTFE and PFA in a proportion of 7:3 and further mixing therewith 30% by weight of medium-resistance particles titanium oxide particles. On this layer 10*c,* the same aqueous dispersion as the above except that 10% by weight of titanium oxide particles were further dispersed therein, was dip-coated in a thickness of about 10 μm, followed by drying and then baking to form a second releasing layer 10*d.*

Thus, in Comparative Example 3, the releasing layer was formed in a thickness of 50 μm in total for the first releasing layer 10*c* and the second releasing layer 10*d.* The surface resistivity and volume resistivity of the fixing roller of Comparative Example 3 were measured to find that the surface resistivity was $1.7\times10^{13}$ Ω and the volume resistivity was $4.4\times10^{14}$ Ωcm.

This fixing roller was set in the same fixing assembly as that in Example 1, and levels at which the offset and the smeared image trailing edges occurred were examined. As the result, the smeared image trailing edges were at a level within tolerance and of no problem. However, the offset was at a serious level such that it was recognizable even in the practical images. This is because the releasing layer formed in a double-layer construction has made it hard for the leak sites to be formed in the releasing layer and, in addition thereto, the titanium oxide particles are dispersed in the second releasing layer in a small quantity, and hence the surface resistivity does not lower and the surface of the fixing roller becomes electrically charged.

COMPARATIVE EXAMPLE 4

A fixing roller 10 was produced in the same manner as in Example 1 except that the releasing layer was formed in a thickness of 50 μm. The surface resistivity and volume resistivity of this fixing roller 10 were measured to find that the surface resistivity was $1.2\times10^8$ Ω and the volume resistivity was $3.9\times10^{14}$ Ωcm.

This fixing roller was set in the same fixing assembly as that in Example 1, and levels at which the offset and the smeared image trailing edges occurred were examined. As the result, the smeared image trailing edges were at a level within tolerance and of no problem. However, the offset was at a serious level such that it was recognizable even in the practical images. This is because the releasing layer formed in a large thickness has made it hard for the leak sites to be formed in the releasing layer, so that the surface resistivity does not lower and the surface of the fixing roller becomes electrically charged.

The results of the foregoing Examples 1 and 2 and Comparative Examples 1 to 4 are shown in Table 1.

TABLE 1

| | Example | | Comparative Example | | | |
|---|---|---|---|---|---|---|
| | 1 | 2 | 1 | 2 | 3 | 4 |
| Surface resistivity (Ω): | $1.5\times10^7$ | $9.9\times10^7$ | $7.7\times10^5$ | $1.2\times10^8$ | $1.7\times10^{13}$ | $1.2\times10^8$ |
| Volume resistivity (Ωcm): | $8.2\times10^{13}$ | $1.7\times10^{13}$ | $1.3\times10^7$ | $9.9\times10^7$ | $4.4\times10^{14}$ | $3.9\times10^{14}$ |
| Anti-offset properties: *1 | A | B | C | C | C | C |
| Proofness to smeared image trailing edges: *2 | A | A | C | B | A | A |

Evaluation Criteria
*1 (anti-offset properties):
A: No problem even in test patterns.
B: Not conspicuous in practical images.
C: Clearly recognizable even in practical images.
*2 (proofness to smeared image trailing edges):
A: No problem even in test patterns.
B: Not conspicuous in practical images.
C: Clearly recognizable even in practical images.

As can be seen from these results, it can be said that, as preferable characteristics necessary for the fixing roller 10, the surface resistivity is $1.0\times10^8$ Ωcm or below and the volume resistivity is $1.0\times10^8$ Ωcm or above. Also, where the conductive particles having a low resistivity are used as in Comparative Examples 1 and 2, it is difficult to control the surface resistivity and volume resistivity within the desired range. Still also, the releasing layer of double-layer construction as in Comparative Example 3 and the releasing layer having a large thickness as in Comparative Example 4 can not form any leak sites effectively, and any suitable surface resistivity and volume resistivity are not obtainable. On the other hand, dispersing the medium-resistance particles or medium-resistance whiskers in the releasing layer as in the present invention enables stable control of the values of surface resistivity without lowering volume resistivity, making it possible to provide a fixing roller having achieved both the anti-offset properties and the proofness to smeared image trailing edges.

In the foregoing Examples and Comparative Examples, the fixing assembly is so constructed that a fixing bias is applied to the hollow mandrel of the fixing roller. In systems where such a fixing bias is not applied, too, the charging of minute regions may occur as a result of paper feeding also in the case of fixing rollers having releasing layers in which only Ketjen Black has been dispersed, and the toner may be attracted to the roller surface to cause offset. Accordingly, in such systems where the fixing bias is not applied, too, the fixing member of the present invention in which the medium-resistance particles or whiskers are dispersed in the releasing layer is effective as a countermeasure for the electrostatic offset.

EXAMPLE 3

A fixing assembly in the present Example is a heat fixing assembly characterized by employment of a heat fixing method of a film-type heat fixing system in which toner images on recording materials are fixed via a film interposed between a heating zone and a pressure roller, in order to keep power consumption as low as possible without supplying any electric power to the heat fixing assembly especially when it is on stand-by.

Figure 3:
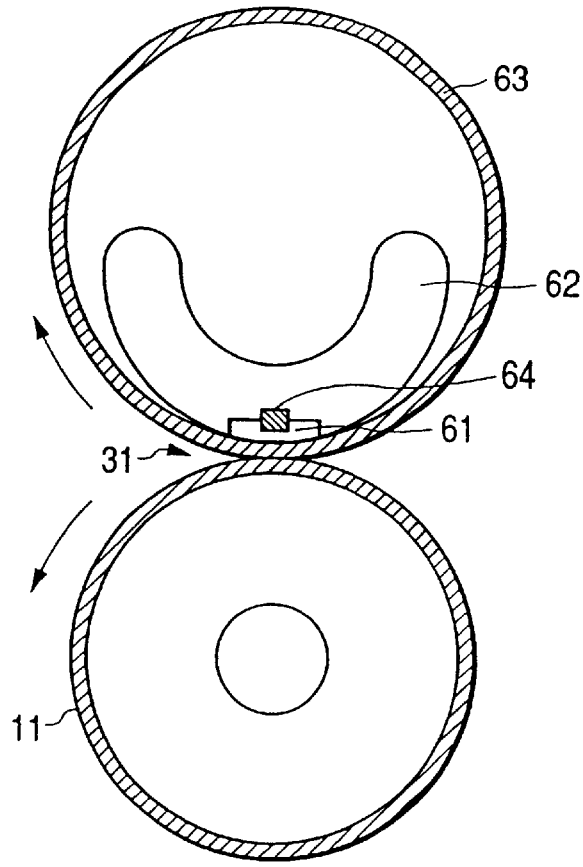
FIG. 3 is a schematic view showing a film-type fixing assembly in a third example of the present invention.

FIG. 3 schematically illustrates the construction of such a heat fixing assembly of a film heat fixing system.

The fixing assembly of the present Example has, as shown in FIG. 3, a stay holder (a support) 62, a heating element (hereinafter "heating resistor") 61 stationarily supported on the stay holder 62, a pressure roller 11 which is a pressure member kept in pressure contact through a pressing means (not shown; e.g., an elastic member such as a spring pressed against a fixing member), a thin-gage film (hereinafter "fixing film") 63 which is a heat-resistant fixing member, and a temperature-detecting means 64 which detects the temperature of the heating resistor 61. A nip 31 (fixing nip 31) is formed in a stated width, interposing the fixing film 63 between the heating resistor 61 and the pressure roller 11.

In the heating resistor 61 as a heating element, a ceramic heating resistor is commonly used. This ceramic heating resistor comprises an electrically insulating, good heat-conductive and low-heat-capacity ceramic substrate, e.g., aluminum, on the surface of which (on the side facing the fixing film 63) an electrification heat-generation resistance layer such as a silver palladium (Ag/Pd) layer or a tantalum nitride ($Ta_2N$) layer has been formed by screen printing over the lengthwise direction (the direction vertical to the drawing surface) of the substrate, and the surface of which heat-generation resistance layer is further covered with a thin-gage glass protective layer.

The stay holder 62 is formed of, e.g., a heat-resistant plastic member. It prevents the heat from dissipating in the direction opposite to the fixing nip 31, holds the heating resistor 61, and serves also as a transport guide of the fixing film 63.

The fixing film 63 is transported and moved in the direction of an arrow by a drive means (not shown) or a rotational force of the pressure roller 11, being slidably moved in close contact with the surface of the heating resistor and the surface of the pressure roller 11 at the fixing nip 31. The fixing film 63 is a member in the form of a cylinder, an endless belt or a roll-type continuous web. The fixing film 63 is formed in a thickness of from 20 to 70 $\mu$m so that the heat of the heating resistor 61 can be transmitted to a heating-target recording material in a good efficiency.

The fixing film 63 is rotated under sliding contact with the heating resistor 61, and hence any frictional resistance between the fixing film and the heating resistor must be made small. Accordingly, a lubricant such as grease having a high heat resistance is kept applied between the fixing film 63 and the heating resistor 61 and between the fixing film 63 and the stay holder 62 surface that may come into contact with the former.

Figure 4:
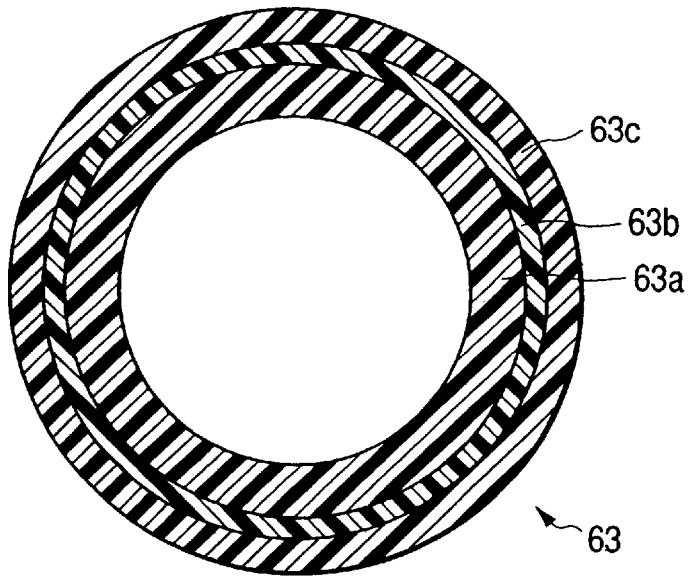
FIG. 4 is a schematic cross-sectional view of a fixing film in the third example of the present invention.
Figure 5:
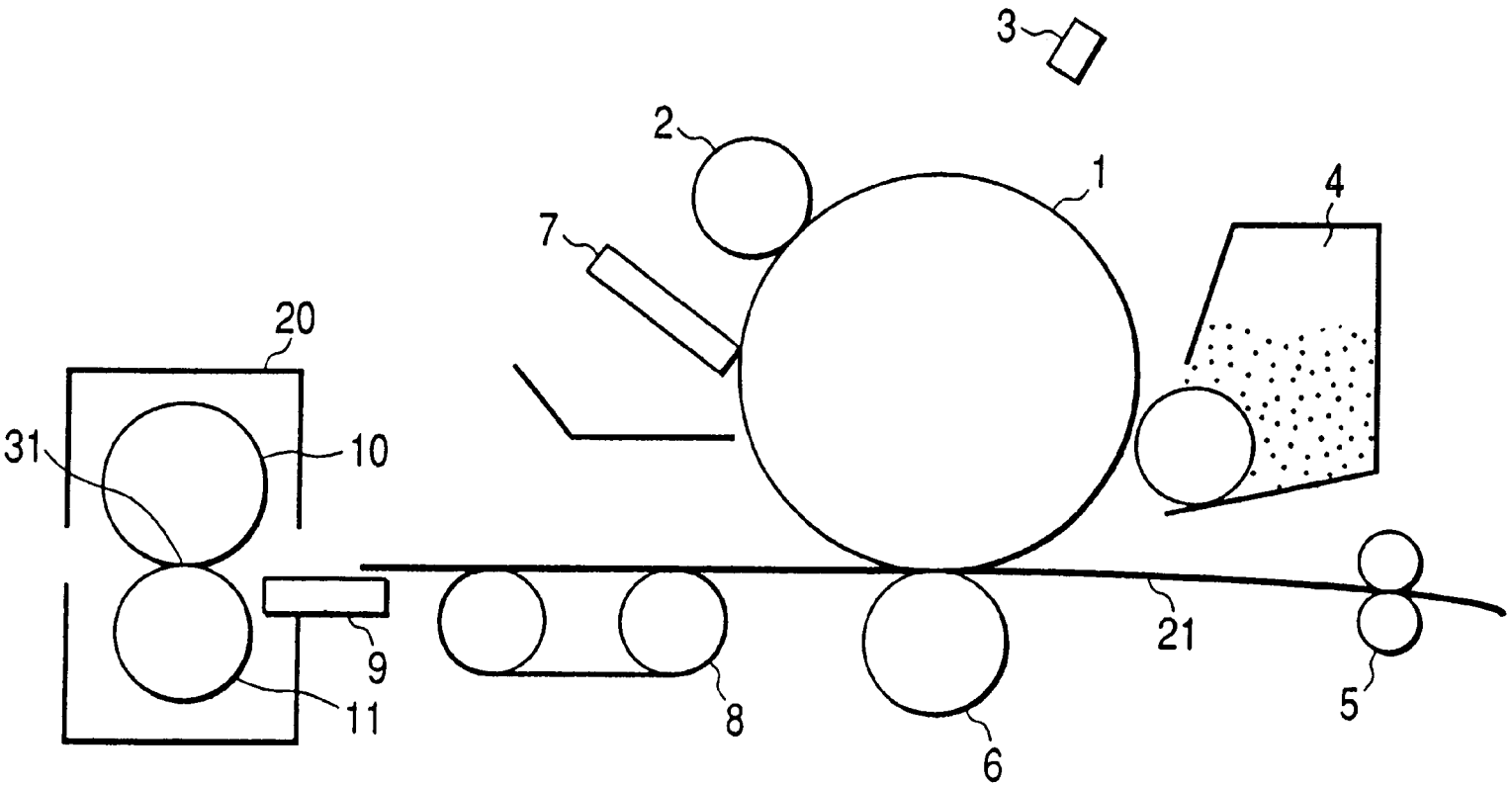
FIG. 5 PRIOR ART
FIG. 5 is a schematic view showing an example of a conventional image-forming apparatus.
Figure 6:
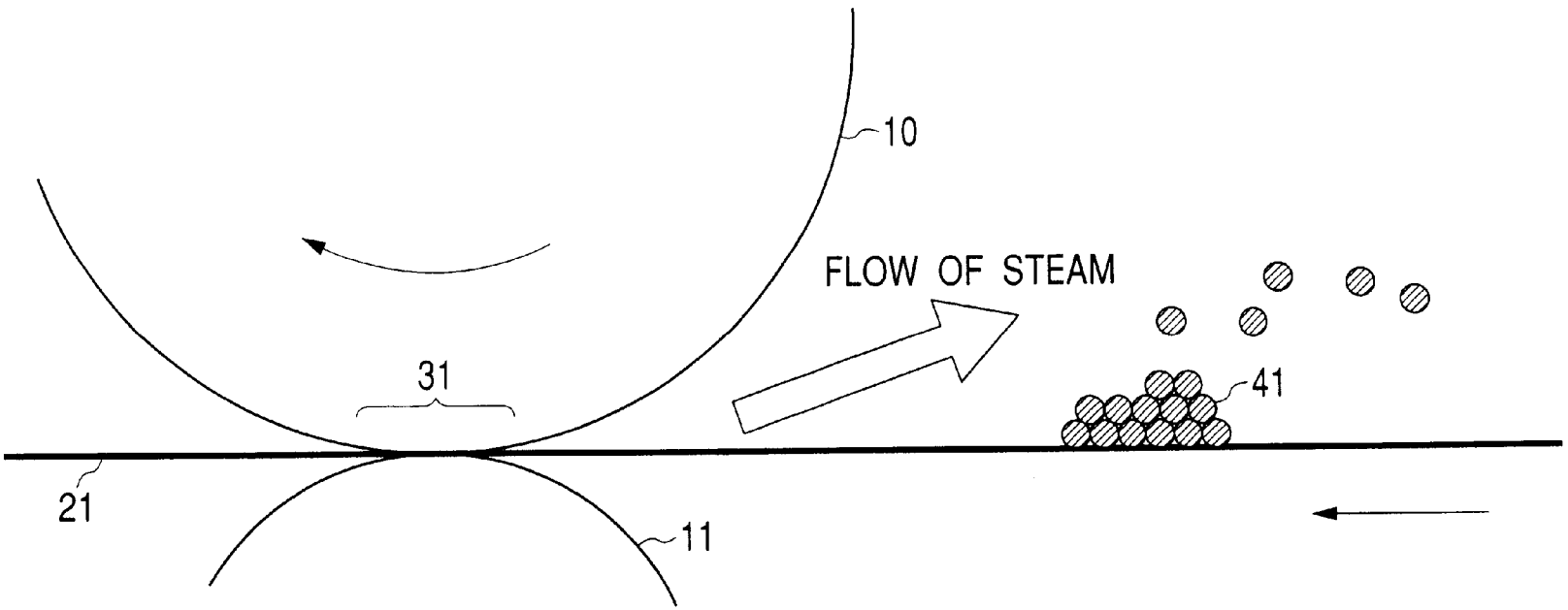
FIG. 6 illustrates the mechanism by which smeared image trailing edges occur.
Figure 7:
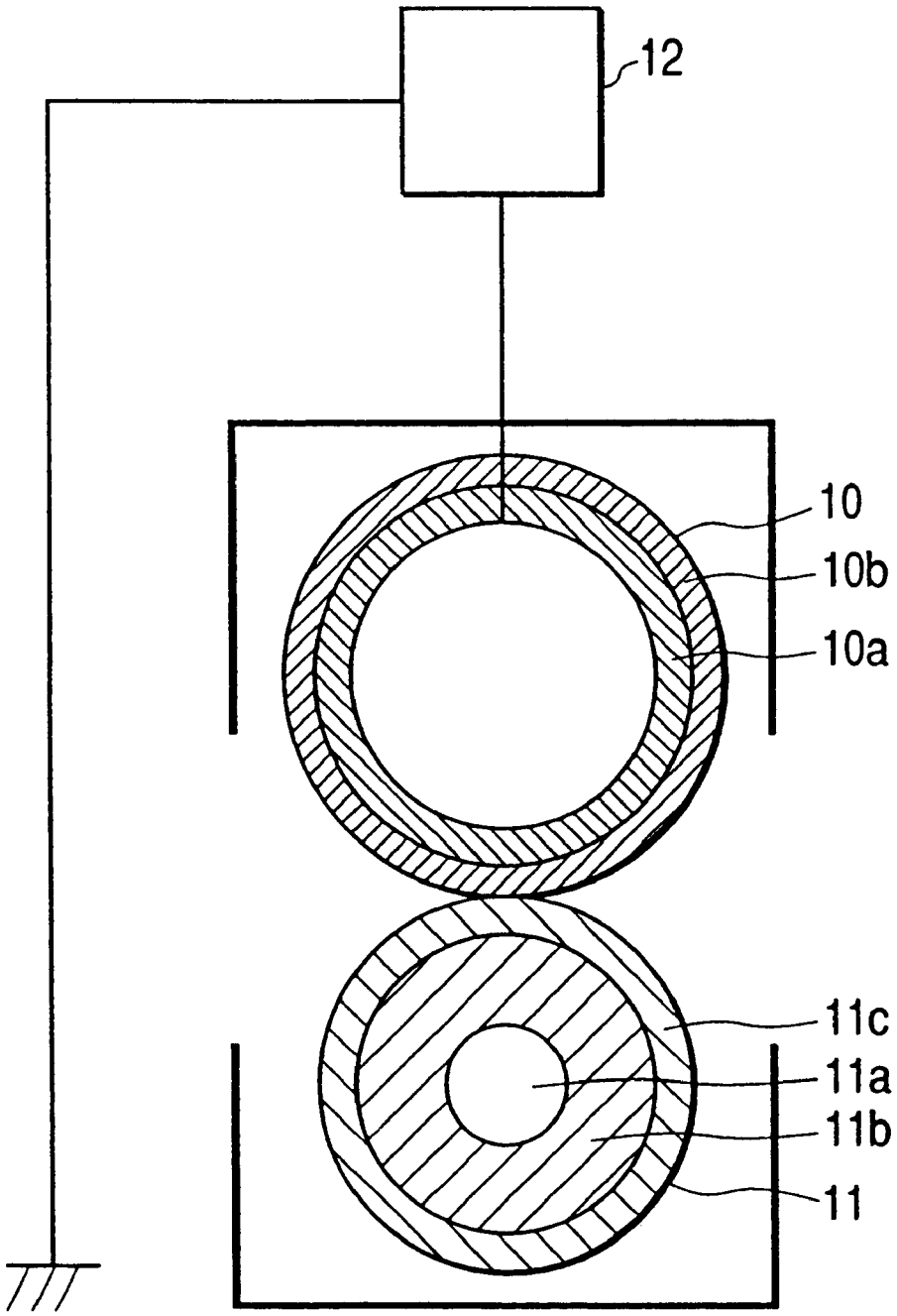
FIG. 7 PRIOR ART
FIG. 7 is a schematic view showing another example of a fixing assembly in the conventional image-forming apparatus.

FIG. 4 illustrates the construction of the fixing film 63 (cylindrical).

The fixing film 63 is constituted of three layers, a film base layer 63*a*, a conductive primer layer 63*b* and a releasing layer 63*c*. The film base layer 63*a* stands on the heating resistor side, and the releasing layer 63*c* on the pressure roller side.

The film base layer 63*a* is formed of highly insulating, polyimide, polyamide-imide or PEEK (polyether ether ketone), has a heat resistance and a high elasticity, has a thickness of from 15 to 60 $\mu$m, and keeps a mechanical strength against the tearing strength of the whole fixing film 63.

The conductive primer layer 63*b* is formed by dip-coating a dispersion mixture of a polyamide resin and a fluorine resin, containing carbon black dispersed therein, and is a thin layer having a thickness of from 2 to 6 $\mu$m. The conductive primer layer 63*b* is connected to a bias power source (not shown) and a DC bias of, e.g., −500 V is applied, in order that an electric field can be formed across the fixing film 63 and the back of the recording material.

The releasing layer 63*c* is, like Example 1, formed by dip-coating an aqueous dispersion prepared by mixing PTFE and PFA in a proportion of 7:3 and further dispersing therein 30% by weight of the same titanium oxide particles as those in Example 1, which have been subjected to hydrophilic treatment with alumina. The surface resistivity and volume resistivity of this fixing film were measured to find that the surface resistivity was $1.5\times10^7$ Ω and the volume resistivity was $8.2\times10^{13}$ Ωcm.

The heating resistor 61 is heated by electrification of the electrification heat-generation resistance layer, whereupon the electrification heat-generation resistance layer generates heat and the whole heating resistor including the ceramic substrate and the glass protective film is rapidly heated. The supply of electricity to the electrification heat-generation resistance layer is so controlled that the heating-resistor temperature for which the temperature rise of this heating resistor 61 is detected by the temperature-detecting means 64 can be kept to a stated substantially constant temperature (fixing temperature). Thus, the heating resistor 61 is heated and temperature-controlled by the heating resistor 61 to a stated fixing temperature.

In the state the fixing film 63 is being transported and moved in the direction of the arrow while the heating resistor 61 is heated and temperature-controlled to a stated temperature, a heating-target recording material on which unfixed toner images have been formed and held is guided in between the fixing film 63 and the pressure roller at the fixing nip 31, where the recording material is interposingly transported through the fixing nip 31 together with the fixing film 63 and in close contact with the surface of the fixing film 63.

At this fixing nip, the recording material and the toner image are heated with the heating resistor 61 through the fixing film 63, and the toner image on the recording material is heat-fixed. At the part having passed the fixing nip, the recording material is separated from the surface of the fixing film 63 and is transported on.

Using the fixing assembly of the present Example, levels at which the offset and the smeared image trailing edges occurred were examined in the same manner as in Example 1. As the result, good results were obtained in all cases.

As described above, the fixing member of the present invention has the conductive layer and the releasing layer formed on the conductive layer, and, in the releasing layer, the medium-resistance particles and/or the medium-resistance whiskers are dispersed, where the releasing layer is so formed as to have a surface resistivity of $1.0\times10^8$ Ω or below and a volume resistivity of $1.0\times10^8$ Ωcm or above. Hence, the part of the medium-resistance particles and/or medium-resistance whiskers serves as leak sites, which can lower the surface resistivity of the fixing member to a level within a specific range and also can make its volume resistivity not unnecessarily small to keep it within a specific range, without dispersing any conductive agent or antistatic agent in the releasing layer of the fixing assembly. Thus, the fixing member can be provided which has superior anti-offset properties and proofness to smeared image trailing edges.

In the fixing member of the present invention, the medium-resistance particles and the medium-resistance whiskers may have a powder resistivity of from $1.0\times10^1$ to $1.0\times10^{12}$ Ωcm. Hence, the part of the medium-resistance particles and/or medium-resistance whiskers serves as leak sites, which can lower the surface resistivity of the fixing member and also can make its volume resistivity not unnecessarily small, without dispersing any conductive agent or antistatic agent in the releasing layer of the fixing assembly. This is more effective for forming the leak sites in a good efficiency and independently controlling the surface resistivity and volume resistivity of the releasing layer when the fixing member having more superior anti-offset properties and proofness to smeared image trailing edges is provided.

In the fixing member of the present invention, the medium-resistance particles and the medium-resistance whiskers may have a powder resistivity of from $1.0\times10^3$ to $1.0\times10^9$ Ωcm. Hence, the part of the medium-resistance particles and/or medium-resistance whiskers serves as leak sites, which can lower the surface resistivity of the fixing member and also can make its volume resistivity not unnecessarily small, without dispersing any conductive agent or antistatic agent in the releasing layer of the fixing assembly. This is much more effective for forming the leak sites in a good efficiency and independently controlling the surface resistivity and volume resistivity of the releasing layer when the fixing member having more superior anti-offset properties and proofness to smeared image trailing edges is provided.

In the fixing member of the present invention, the medium-resistance particles and the medium-resistance whiskers may have surfaces having been subjected to hydrophilic treatment. This enables ions to be trapped to the particle or whisker surfaces and the vicinity thereof to lower the surface resistivity more effectively, and is more effective for providing the fixing member having achieved both anti-offset properties and proofness to smeared image trailing edges.

In the fixing member of the present invention, the medium-resistance whiskers may be whiskers of a metal oxide. This can improve strength of the releasing layer of the fixing member and can improve resistance to wear simultaneously. Thus, this is more effective for providing the fixing member having superior anti-offset properties and proofness to smeared image trailing edges.

In the fixing member of the present invention, the medium-resistance whiskers may be metal oxide whiskers whose surfaces have been subjected to hydrophilic treatment. This is much more effective for providing the fixing member having superior anti-offset properties and proofness to smeared image trailing edges.

In the fixing member of the present invention, the medium-resistance particles may be titanium oxide particles whose surfaces have been subjected to hydrophilic treatment. This is much more effective for providing the fixing member having superior anti-offset properties and proofness to smeared image trailing edges.

In the fixing member of the present invention, the medium-resistance particles and/or the medium-resistance whiskers may be contained in the releasing layer in a total amount of from 5 to 50% by weight based on the weight of the releasing layer. This is much more effective for providing the fixing member having achieved both anti-offset properties and proofness to smeared image trailing edges.

In the fixing member of the present invention, the releasing layer may contain any one or both of the medium-resistance particles and the medium-resistance whiskers and a fluorine resin. This is much more effective for improving release properties and resistance to heat when the fixing member having achieved both anti-offset properties and proofness to smeared image trailing edges is provided.

In the fixing member of the present invention, the releasing layer may be so formed as to have a surface resistivity of from $1.0\times10^3$ to $1\times10^8$ Ω and a volume resistivity of from $1.0\times10^8$ to $1\times10^{15}$ Ωcm. This is much more effective for providing the fixing member having achieved both anti-offset properties and proofness to smeared image trailing edges.

In the fixing member of the present invention, the releasing layer may have a layer thickness of from 1 to 45 μm. This is more effective for achieving both durability and fixing assembly thermal efficiency when the fixing member having achieved both anti-offset properties and proofness to smeared image trailing edges is provided.

In the fixing member of the present invention, the releasing layer may have a layer thickness of from 3 to 30 μm. This is much more effective for making up a fixing assembly having a good thermal efficiency and advantageous for making the apparatus compact when the fixing member having achieved both anti-offset properties and proofness to smeared image trailing edges is provided.

The fixing member of the present invention may be formed in the form of a roll. This is much more effective for achieving a higher process speed of the apparatus when the fixing member having achieved both anti-offset properties and proofness to smeared image trailing edges is provided.

The fixing member of the present invention may be formed in the form of a belt or a film. This is much more effective for providing the fixing member having a higher heat transfer efficiency when the fixing member having achieved both anti-offset properties and proofness to smeared image trailing edges is provided.

In the present invention, in the fixing assembly having a fixing member and a pressure member coming into pressure contact with the fixing member to form a fixing nip, where the recording material on which an unfixed toner image has been formed is passed through the fixing nip so as to fix the unfixed toner image to the recording material to form a fixed imaged on the recording material, the fixing assembly is characterized in that the fixing member is the specific fixing member described above. Thus, since such a fixing member is provided, the fixing assembly having achieved both anti-offset properties and proofness to smeared image trailing edges can be provided.

In the fixing assembly of the present invention, a potential difference may be provided between the releasing layer and the conductive layer. This is much more effective for providing the fixing assembly having achieved both anti-offset properties and proofness to smeared image trailing edges.

In the present invention, in the image-forming apparatus having an image-bearing member for holding thereon an electrostatic latent image, a charging means for charging the surface of the image-bearing member electrostatically, an electrostatic latent image forming means for forming an electrostatic latent image on the surface of the image-bearing member thus charged, a developing means having a developer and by which the electrostatic latent image formed on the image-bearing member is developed to form a toner image, a transfer means for transferring the toner image onto a recording material, and a fixing assembly by means of which the toner image transferred onto the recording material and standing unfixed is fixed to form a fixed image, the image-forming apparatus is characterized in that the fixing assembly is the specific fixing assembly described above. Thus, since such a fixing assembly is provided, the image-forming apparatus having achieved both anti-offset properties and proofness to smeared image trailing edges can be provided.

What is claimed is:

1. A fixing member for use in a fixing assembly, wherein the fixing assembly has at least the fixing member and a pressure member coming into pressure contact with the fixing member to form a fixing nip, where a recording material holding an unfixed toner image thereon is passed through the fixing nip so as to fix the unfixed toner image to the recording material to form a fixed imaged on the recording material;

said fixing member comprising a conductive layer and a releasing layer formed on the conductive layer, wherein;

in said releasing layer, any one or both of medium-resistance particles and medium-resistance whiskers are dispersed;

said releasing layer has a surface resistivity of $1.0\times10^{8}$ Ω or below and a volume resistivity of $1.0\times10^{8}$ Ωcm or above, and said medium-resistance whiskers have surfaces having been subjected to hydrophilic treatment.

2. The fixing member according to claim 1, wherein said medium-resistance particles have a powder resistivity of from $1.0\times10^{1}$ Ωcm to $1.0\times10^{12}$ Ωcm.

3. The fixing member according to claim 1, wherein said medium-resistance particles have a powder resistivity of from $1.0\times10^{3}$ Ωcm to $1.0\times10^{9}$ Ωcm.

4. The fixing member according to claim 1, wherein said medium-resistance whiskers have a powder resistivity of from $1.0\times10^{1}$ Ωcm to $1.0\times10^{12}$ Ωcm.

5. The fixing member according to claim 1, wherein said medium-resistance whiskers have a powder resistivity of from $1.0\times10^{3}$ Ωcm to $1.0\times10^{9}$ Ωcm.

6. The fixing member according to claim 1, wherein said medium-resistance particles have surfaces having been subjected to hydrophilic treatment.

7. The fixing member according to claim 1, wherein said medium-resistance particles are titanium oxide particles whose surfaces have been subjected to hydrophilic treatment.

8. The fixing member according to claim 1, wherein said medium-resistance particles are titanium oxide particles whose surfaces have been subjected to hydrophilic treatment with aluminum oxide.

9. The fixing member according to claim 1, wherein said medium-resistance whiskers have surfaces having been subjected to hydrophilic treatment with aluminum oxide.

10. The fixing member according to claim 1, wherein said medium-resistance whiskers are whiskers of a metal oxide.

11. The fixing member according to claim 1, wherein any one or both of said medium-resistance particles and said medium-resistance whiskers are contained in the releasing layer in an amount of from 5% by weight to 50% by weight based on the weight of the releasing layer.

12. The fixing member according to claim 1, wherein any one or both of said medium-resistance particles and said medium-resistance whiskers are contained in the releasing layer in an amount of from 10% by weight to 40% by weight based on the weight of the releasing layer.

13. The fixing member according to claim 1, wherein said releasing layer contains any one or both of said medium-resistance particles and said medium-resistance whiskers and a fluorine resin.

14. The fixing member according to claim 1, wherein said releasing layer has a surface resistivity of from $1.0\times10^{3}$ Ω to $1\times10^{8}$ Ω and a volume resistivity of from $1.0\times10^{8}$ Ωcm to $1\times10^{15}$ Ωcm.

15. The fixing member according to claim 1, wherein the value of volume resistivity of the releasing layer is larger than the value of surface resistivity of the releasing layer.

16. The fixing member according to claim 1, wherein said releasing layer has a layer thickness of from 1 μm to 45 μm.

17. The fixing member according to claim 1, wherein said releasing layer has a layer thickness of from 3 μm to 30 μm.

18. The fixing member according to claim 1, which has the form of a roll.

19. The fixing member according to claim 1, which has the form of a belt.

20. The fixing member according to claim 1, which has the form of a film.

21. The fixing member according to claim 1, which is a fixing roll.

22. The fixing assembly comprising a pressure member and a fixing member as in any one of claims 1 to 20.

23. A fixing assembly comprising a fixing member and a pressure member coming into pressure contact with the fixing member to form a fixing nip, wherein;

a recording material holding an unfixed toner image thereon is passed through said fixing nip so as to fix the unfixed toner image to said recording material to form a fixed imaged on said recording material; and said fixing member comprises a conductive layer and a releasing layer formed on the conductive layer, wherein;

in said releasing layer, any one or both of medium-resistance particles and medium-resistance whiskers are dispersed; and said releasing layer has a surface resistivity of $1.0\times10^8$ Ω or below or a volume resistivity of $1.0\times10^8$ Ωcm or above, and said medium-resistance whiskers have surfaces having been subjected to hydrophilic treatment.

24. The fixing assembly according to claim 23, wherein said fixing member is a fixing roller and said pressure member is a pressure roller.

25. The fixing assembly according to claim 23, wherein said fixing member is a fixing film and said pressure member is a pressure roller.

26. An image-forming apparatus comprising:

an image-bearing member for holding thereon an electrostatic latent image;

a charging means for charging the surface of the image-bearing member electrostatically;

an electrostatic latent image forming means for forming an electrostatic latent image on the surface of the image-bearing member thus charged;

a developing means having a developer and by which the electrostatic latent image formed on the image-bearing member is developed to form a toner image;

a transfer means for transferring the toner image onto a recording material; and a fixing assembly by means of which the toner image transferred onto the recording material and standing unfixed is fixed to form a fixed image;

wherein;

said fixing assembly comprises a fixing member and a pressure member coming into pressure contact with the fixing member to form a fixing nip, wherein;

a recording material holding an unfixed toner image thereon is passed through said fixing nip so as to fix the unfixed toner image to said recording material to form a fixed imaged on said recording material; and said fixing member comprises a conductive layer and a releasing layer formed on the conductive layer, wherein;

in said releasing layer, any one or both of medium-resistance particles and medium-resistance whiskers are dispersed; and said releasing layer has a surface resistivity of $1.0\times10^8$ Ω or below and a volume resistivity of $1.0\times10^8$ Ωcm or above, and said medium-resistance whiskers have surfaces having been subjected to hydrophilic treatment.

27. The image-forming apparatus according to claim 26, wherein said fixing member is a fixing film and said pressure member is a pressure roller.

* * * * *

UNITED STATES PATENT AND TRADEMARK OFFICE

CERTIFICATE OF CORRECTION

PATENT NO. : 6,438,349 B2
DATED : August 20, 2002
INVENTOR(S) : Atsutoshi Ando

It is certified that error appears in the above-identified patent and that said Letters Patent is hereby corrected as shown below:

Column 2,
Line 10, “the both” should read -- both --.

Column 4,
Line 3, “imaged” should read -- image --.

Column 9,
Line 61, “the the” should read -- the --.

Column 10,
Line 35, “Using” should read -- using --.

Column 12,
Line 31, “the both.” should read -- both. --.

Column 13,
Line 35, “the both” should read -- both --.

Column 21,
Line 9, “imaged” should read -- image --.

Column 22,
Line 60, “imaged” should read -- image --.

Column 24,
Line 9, “imaged” should read -- image --.

Signed and Sealed this

Thirty-first Day of December, 2002

JAMES E. ROGAN
*Director of the United States Patent and Trademark Office*